United States Patent [19]

Benko

[11] Patent Number: 4,478,425

[45] Date of Patent: Oct. 23, 1984

[54] FIFTH WHEEL PLATE

[76] Inventor: John M. Benko, 1439 River Dr., Munster, Ind. 46321

[21] Appl. No.: 435,563

[22] Filed: Oct. 21, 1982

[51] Int. Cl.[3] ..... B62D 53/08

[52] U.S. Cl. ..... 280/433; 29/402.13; 29/402.16; 384/421

[58] Field of Search ..... 280/433; 384/421, 422, 384/423; 105/199 C; 410/56, 58, 59, 60, 61, 62, 63, 64; 29/402.13, 402.16

[56] References Cited

U.S. PATENT DOCUMENTS

| | | | |
|---|---|---|---|
| 2,148,925 | 2/1939 | Bochy | 29/402.16 |
| 3,473,854 | 10/1969 | Shafer | 384/422 |
| 3,599,574 | 8/1971 | Robertson | 105/200 |
| 3,711,927 | 1/1973 | Davidson | 105/199 C |
| 3,832,954 | 9/1974 | Amwake | 105/199 C |
| 3,894,676 | 7/1975 | Oppenheim et al. | 384/423 |
| 4,179,998 | 12/1979 | Niggemeier et al. | 410/64 |

*Primary Examiner*—David M. Mitchell
*Assistant Examiner*—D. Lynn Fugate

[57] ABSTRACT

This invention relates to a fifth wheel stand as used for hitching a semi-trailer on a railway flat car for over-the-rail hauling of such trailers and is especially directed to a system of repair for the fifth wheel, or top plate, of the hitch which includes a shoe, or insert, that is welded into the king-pin slot of the top plate to replace metal removed in the repair procedure and thus restore the king-pin slot to specified size. The insert preferably is made from hot formed bar stock, but also can be made as a casting, or can be formed as a forging.

2 Claims, 12 Drawing Figures

FIG. 1
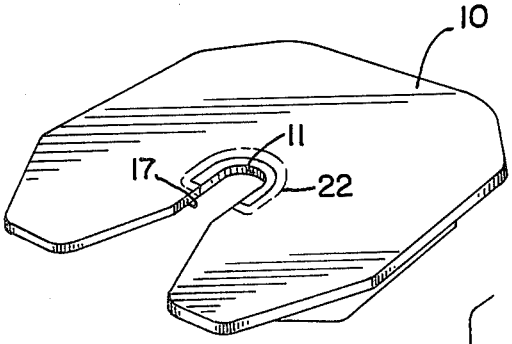
FIG. 2
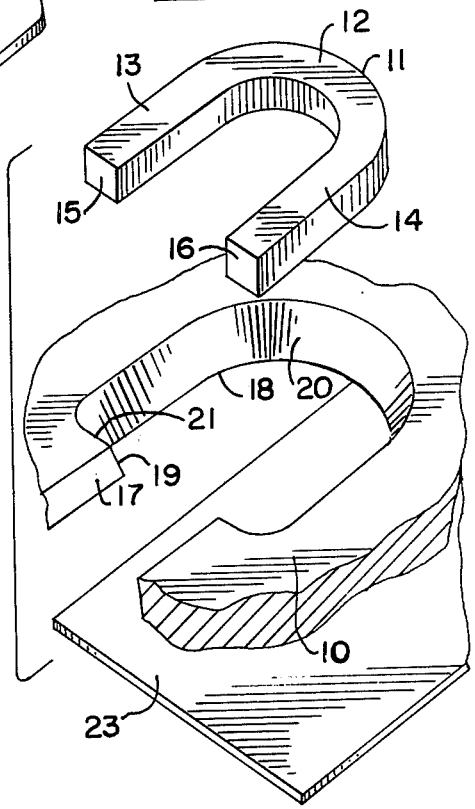
FIG. 4
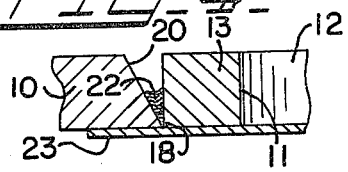
FIG. 5
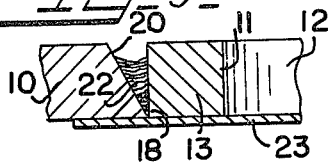
FIG. 3
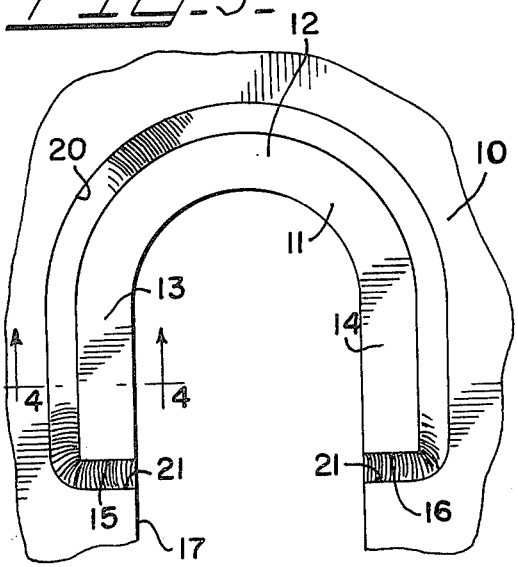
FIG. 6
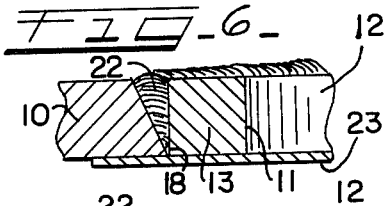
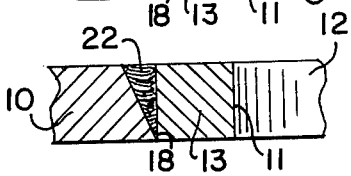
FIG. 7

FIG. 8
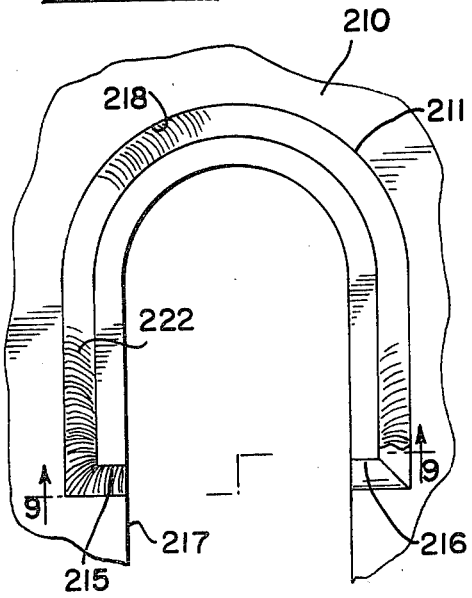
FIG. 9
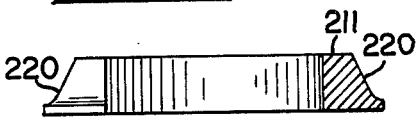
FIG. 11
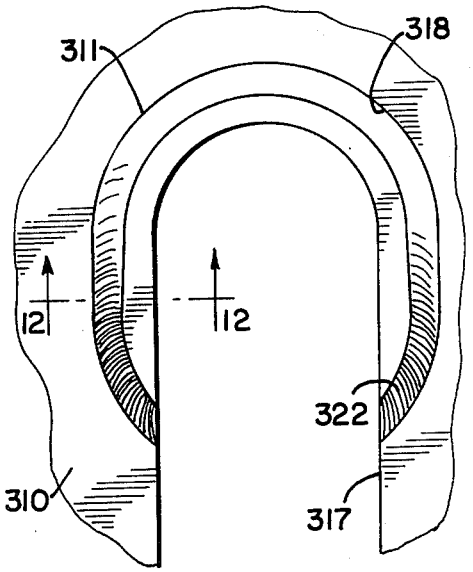
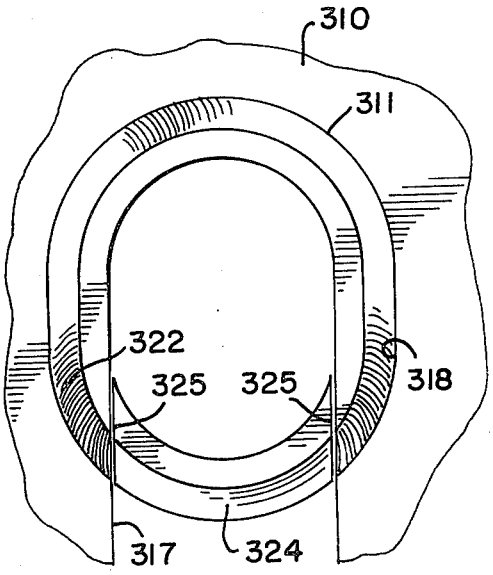
FIG. 10
FIG. 12
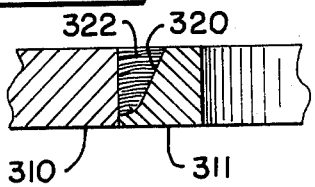

FIFTH WHEEL PLATE

BACKGROUND OF THE INVENTION

1. Field Of The Invention

The field of this invention pertains to fifth wheel stands, or hitches as used on railway flat cars for securing semi-trailers and more especially relates to repair procedures for the top plate of such hitches.

2. Description Of The Prior Art

With the advent of piggy back operations in the railroad field the use of fifth wheel stands on railway cars has become quite common and hitches of this type are extensively used in connection with the transportation of trailers on railway flat cars. However, railroad operations are quite severe for cars in such service, what with hump yard switching and the like, as well as general over-the-road service.

Such service imposes draft and buffing shocks on the cars and the fifth wheel stand structure and this results in excessive impacts in the area of the fifth wheel plate, particularly in the king-pin receptacle which secures the trailer on the car. This causes excessive wear in this king-pin socket and as a consequence the fit of the pin in the socket becomes loose and may have the dangerous effect of allowing a trailer secured by such a worn connection, to become loosened, or detached from the hitch and possibly fall off the flat car.

These worn hitch connections have necessitated repairs to the top plate in the king-pin receiving area in order to restore some semblance of a safe connection for a trailer and the system of repairing these top plates in past general practice has consisted of directly building up the worn areas around a king-pin slot by weld metal applied to such areas, using flux cored welding wires in a multi-pass welding procedure until the build-up of the worn areas has been restored sufficiently to enable the king-pin opening to be machined to the normally specified size. This type of repair procedure has taken as little as one man hour, or as much as a full day, dependent upon the severity and the amount of wear encountered. This repair time is required for each hitch and in addition, the procedure entailed excessive material handling time as a result of both the welding and the machining operations.

The excessive wear conditions encountered in king-pin locking plates as a result of abrasion caused primarily by impacts has indicated a need for a consistently reliable repair procedure which afforded an economical means of restoring the top plate for quick return to normal service. A large number of hitches for both trailer and container service have been built and none of these hitches are immune to the severe wear that results from the service conditions normally encountered and therefore the need for a complete repair system has fully indicated the need for a reliable repair system to fill a gap that exists in the hitch repair field.

It has been known in the prior art to compensate for wear by the provision of a shim, or the like. Liners have been provided for this purpose and some of these have been installed after machining of a surface intended to mount the liner, but none of these has been integrated with the worn area and none has been provided for a fifth wheel plate. Examples of such prior arrangements are revealed in Pat. Nos. 3,473,854, 3,599,574, 3,711,927, 3,832,954 and 3,894,676.

SUMMARY OF THE INVENTION

The invention involves a new insert shoe for the king-pin opening in the top plate and a repair procedure that eliminates much of the previous material handling and machining operations through the utilization of such a shoe, which is made to finished size and welded in place, after which it is air hardened. When the repair shoe has been inserted into the king-pin opening in the top plate and welded in place it is flame heated to a cherry red by application of a torch and then allowed to air cool to obtain a desired hardness profile.

This manner of repairing the top plate is entirely independent of the amount of wear that has occurred in the king-pin opening and in view of which every hitch will require the same amount of time out of service for effecting the repairs. The repair procedure necessitates as a first step that the worn area around the king pin opening be burned out to predetermined dimensions in accordance with the size of the shoe to be inserted. The shoe is then fitted into the opening and tack welded in place flush with the back side of the top plate. A copper plate is utilized as a backup for the welding operation.

The tack welded assembly is preheated to a prescribed temperature and then welded by three passes of the welding wire from the top side of the fifth wheel plate whereby all of the welding is made by down-hand welds. The shoe insert and the applied weld material are then ground flush with the top and bottom surfaces of the fifth wheel plate. It is after this grinding operation that the insert is heat treated by applying a torch to obtain the desired temperature before air cooling. This heat treatment is designed to obtain a uniform profile extending back from the wear surface for one-fourth of an inch. The total time for this entire repair procedure is obtained in approximately one hour.

DESCRIPTION OF THE DRAWINGS

The purposes of the invention as hereinbefore referred to are obtained by the structure and procedures illustrated in the accompanying drawings, wherein FIG. 1 is a general perspective view of a fifth wheel top plate showing the king-pin opening reinforced with an insert shoe of this invention;

FIG. 2 also is a perspective view but fragmentary, showing the king-pin area of the fifth wheel plate in larger scale detail, with the insert shown exploded above the king-pin opening and the copper backup plate beneath the top plate;

FIG. 3 is a top plan view of the king-pin slot area of the top plate with the insert shoe in place and secured by welding;

FIG. 4 is a detail sectional view taken on the line 4—4 of FIG. 3, showing the first step of securing the insert shoe in the king-pin opening illustrating the weld metal deposited by the first welding pass and backed up by the copper backing plate;

FIG. 5 is a similar detail sectional view through the welded area illustrating the weld metal deposited by the third and final welding pass;

FIG. 6 is a similar detail sectional view through the welded area illustrating the weld metal deposited by the third and final welding pass;

FIG. 7 is a detail sectional view through this same welded area but with the deposited weld metal ground smooth, both top and bottom surfaces of the top plate and with the copper back-up plate removed;

FIG. 8 is a top plan view of the application of a modified form of the insert shoe secured in place in the king-pin opening of a top plate;

FIG. 9 is a detail partial end view of the modified insert shoe looking at the open end thereof on one side and the other side shown in section as taken on the line 9—9 in FIG. 8.

FIG. 10 is a further modified form of the insert shoe, utilizing a shoe of elliptical ring form welded into the king-pin opening of the fifth wheel plate and shown in plan;

FIG. 11 is a plan view also and illustrates the elliptical ring shoe after one end portion has been removed to leave the king-pin opening in the top plate open at one end for receiving a king-pin in the usual way; and FIG. 12 is a detail sectional view taken on the line 12—12 of FIG. 11 showing the ring shaped shoe in section and secured by weld metal between the shoe and top plate, which has been ground smooth after the final welding pass.

DESCRIPTION OF PREFERRED EMBODIMENT

FIGS. 1 through 7 illustrate the preferred type of insert shoe construction and which comprises the most economical application of the invention. FIG. 1 shows the insert shoe in place in a fifth wheel plate, but FIGS. 2 and 3 best illustrate the actual structure of the shoe and the king-pin opening in the top plate. The fifth wheel plate is indicated by the general reference character 10 and the insert shoe is indicated by the reference 11. The insert shoe is generally U-shaped with a continuously rounded rear end portion 12 merging into side leg portions 13 and 14 which terminate in square ends 15 and 16.

The king-pin opening 17 is enlarged at its closed rear end to receive the shoe 11, which is fitted in relation to the enlarged opening. This enlarged opening, in an existing fifth wheel plate is obtained by cutting, or burning out the plate area around the king-pin opening, as at 18, to exactly fit the shoe 11 including terminal end portions 19. The cutout 18 is cut to its final size, including chamfered, or sloping walls 20 and 21 which provide a generally U-shaped fillet around the entire dimension of the insert 11 to provide a groove that is filled in with weld metal securing the insert in the king-pin opening. The weld metal 22 is applied in the fillet 20 and the end fillets 21, in three welding passes around the insert shoe, which fill the groove on all sides and ends of the shoe so that a secure attachment is obtained in relation to the enclosing top plate.

During these welding operations, which utilize flux cored welding wire, the top plate and the insert shoe are backed up on the bottom side by a copper plate 23, which also has the effect of disposing the shoe flush with the bottom side of the fifth wheel plate 10. When the three welding passes have been completed, filling the spaces around the shoe 11, as best indicated in FIG. 6, the excess weld metal is ground off to provide smooth, flush surfaces top and bottom of the assembly, as best indicated in FIG. 7, thus completing the installation of the insert shoe 11 into the king-pin enlarged opening 18.

It is not necessary to machine the finished assembly but the insert shoe 11 is heat treated after the installation is completed. The shoe is made from hot formed bar stock, utilizing 4130 high carbon high strength steel and after welding of the shoe into the king-pin opening of the fifth wheel plate, it is flame heated to a cherry red by the application of a torch and then allowed to air cool to obtain a desired hardness profile.

On an existing worn fifth wheel plate, the step-by-step procedure for installing the insert shoe involves first burning out the area of the fifth wheel plate around the king-pin opening to prescribed dimensions, as determined by the size and contours of the insert. Approximate time required for this cutting operation involves about three minutes, after which the burned edges are cleaned and smoothed with a grinder. This consumes approximately five minutes more.

The insert shoe is fitted into the cut out opening 18 and tack welded in place flush with the back side of the fifth wheel plate. The copper plate 23 is utilized as a back-up for the welding operations and also serves as a gauge for locating the shoe flush with the back side of the plate 10. The tack welding procedure utilizes one-eighth inch electrodes and the approximate time consumed amounts to about two minutes.

The tack welded assembly is preheated to a minimum temperature of 300° F. and is then welded with the flux cored welding wire. The welding is performed in three welding passes and after each pass the weld is thoroughly cleaned before a subsequent welding pass is made. The approximate time required for each welding pass is about one minute so that the total time from the start of the preheat step to the finished welding operation is about fifteen minutes.

After the welding operations are completed the insert shoe and the applied weld metal are manually ground until they present a flush surface with the top surface of the fifth wheel plate and the bottom surfaces are similarly prepared for a smooth flush surface. The approximate time for this manual grinding consumes about thirty minutes.

The insert shoe is then heat treated by flame heating it with a torch until it attains a cherry red color, after which it is allowed to air cool and this heat treatment requires approximately five minutes. This treatment provides a uniform Rockwell hardness profile of 40–46 extending back from the wear surface for about one-fourth inch. Thus, the total time for repairing an existing fifth wheel plate as distinguished from a new structure, requires about one hour. The procedure therefore provides a reliable repair system for existing fifth wheel plates with consistent results and which is fast and economical. Accordingly, this invention fills a need for an effective repair structure and procedure that fulfills all of these requirements.

DESCRIPTION OF MODIFIED EMBODIMENT

FIGS. 8 and 9 illustrate a variation of the insert shoe hereinbefore described, but which is applied in a substantially similar manner and utilizing the same procedure. In this arrangement, the insert shoe 211 is comprised of an alloy steel casting but a similar structure might be formed as a forging. Like the previous structure, this insert shoe is made to finish size so that no trimming is required to fit it into the top plate king-pin opening and just the fact that this design is made as a casting enables this goal to be attained most readily.

This type of insert shoe whether it is made as a steel casting, or as a forging, is formed to incorporate a welding fillet, or groove, within the structure of the shoe. As best seen in FIG. 9, the insert 211 is chamfered, as at 220, which extends entirely around the outer side of the shoe and the groove formed by this chamfered surface and the surrounding wall of the king-pin opening 21 in the fifth wheel plate 210 is filled with weld metal, also applied in three welding passes as in the previously described procedure. The ends 215 and 216 of this U-shaped casting, or forging, are recessed into the cut-out 218 and welded just as in the previous structure.

The weld metal is indicated in FIG. 8 at 222 and extends across the chamfered ends 215 and 216 to provide a welded securement all around the insert within the recess of the cut-out 218. The ends 215 and 216 are chamfered like the two sides in order to provide for equal weld material at all points between the insert and the surrounding recess 218 and after the excess weld metal is ground off from the top and bottom surfaces of the plate 210 and the insert, including any weld metal projecting into the king-pin opening 217 where the insert ends 215 and 216 are welded in the recess 218 so that flush surfaces are provided on the top and bottom sides of the fifth wheel plate and smooth side walls are assured in the opening 217 for movement of a king-pin in and out of the fifth wheel plate.

DESCRIPTION OF FURTHER MODIFIED EMBODIMENT

The insert shoe structure shown in FIGS. 10, 11 and 12 illustrate a further modification of the insert shoe for installation into an enlarged area of a king-pin opening to restore the opening to originally specified size by replacing material removed because of wear, with the shoe. In this arrangement, the insert shoe is made in the form of an elliptically shaped ring 311 that is fitted into the enlarged opening 318 in the fifth wheel plate 310 and secured by welding 322 extending along the two sides of the shoe and around the rounded end of the shoe at the rear of the opening 318 to provide a continuous weld securing the shoe in the enlarged recess formed by the cut-out 318.

The shoe 311 is chamfered on its outer side as at 320, best revealed in FIG. 12 and this chamfer extends entirely around the ring so that the continuous weld 322 will be disposed in the fillet, or groove, thus formed between the insert shoe and the adjacent edge of the cut-out 318. This welding is completed in three passes around the shoe just as in the previous structures with the weld thoroughly cleaned between passes. After the ring shaped shoe 311 is integrated with the fifth wheel plate 310 by the welding 322 the end portion 325 is separated from the installed portion of the ring and removed so that the king-pin slot 317 is opened at this end for entry of the pin into the slot where it is locked in the usual manner.

The piece 324 is removed by cutting it free from the installed ring as by burning at the two positions 325 and when the cuts are made the piece 324 will drop out. The cut surfaces are then ground smooth and flush with the inside edges of the slot 317 so that no obstruction is presented to the movements of the king-pin in and out of the lock position.

CONCLUSION

It is important to note in all three insert shoe structures described that the weld material securing the shoe in the fifth wheel plate extends continuously entirely about the shoe from one welded end along the adjacent side, around the curved end portion, along the second side to and including the other end. It is important also to note that the design of the several structures is such that all of the welds integrating the insert shoe with the fifth wheel plate are made by down-hand welding which is the most effective and efficient way that welds of the type disclosed can be made.

The structure herein disclosed provides the most economical and most effective structure for reinforcing a king-pin opening in a fifth wheel plate and particularly when the present insert shoe is used to repair a badly worn king-pin opening are cut away and the fifth wheel plate is repaired by inserting the present shoe into the opening thus enlarged and securely welded in place so that the fifth wheel plate becomes like new.

Present day repair procedures for restoring fifth wheel plates by renewing the king-pin opening require anywhere from at least an hour to a full day. The present invention requires but one hour for each fifth wheel plate repaired and eliminates the process of building up the king-pin opening to compensate for wear by repeatedly applying weld metal until the worn area is built up sufficiently to enable the plate to be machined in order to attain a specified size of the opening.

This system eliminates the necessity for such machining operations and reduces the material handling time caused by the repetitive welding procedures all by means of the prefabricated shoe which is formed to its finish size and inserted in the king-pin opening which has been burnt out to accept the insert. The insert shoe is constructed independently of the amount of wear in the king-pin opening because the shoe is of a fixed size and the opening is cut out to fit the shoe so that every fifth wheel plate converted under this system requires the same amount of repair time.

What is claimed is:

1. A fifth wheel top plate including a king pin opening in the general form of an open ended slot having a rounded rear portion defining a closed end of the slot and parallel side leg portions with squared ends defining opposite sides of the slot, an insert piece for the top plate comprising a shoe having a rounded rear and parallel side legs with square ends fitted into said slot and welded to the top plate flush with top and bottom surfaces of the plate, said shoe comprising a lining for the inner surfaces of the rear and side leg portions of said slot, said shoe having a rectangular cross section, said top plate chamfered around the top edge of said slot, and weld metal in the groove formed by the chamfer integrally securing said shoe within the slot entirely around said rounded rear portion along said side leg portions and at said squared ends.

2. A fifth wheel top plate including a king pin opening in the general form of an open ended slot having a rounded rear portion defining a closed end of the slot and parallel side leg portions with squared ends defining opposite sides of the slot, an insert piece for the top plate comprising a shoe having a rounded rear and parallel side legs with square ends fitted into said slot and welded to the top plate flush with top and bottom surfaces of the plate, said shoe comprising a lining for the inner surfaces of the rear and side leg portions of said slot, said shoe having a generally rectangular cross section and having a weld metal receiving groove bordering said slot at the rounded rear and the parallel side legs and said squared ends, and weld metal in the groove integrally securing the shoe to the edge of the slot in said top plate.

* * * * *